United States Patent [19]

Gibbens et al.

[11] Patent Number: 4,805,243

[45] Date of Patent: Feb. 21, 1989

[54] PADDED PANT CONSTRUCTION FOR ATHLETIC PURPOSES

[76] Inventors: John C. Gibbens, 530 Kourt Dr., Eugene, Oreg. 97404; Arlene Haislip, 381 Heritage Oaks, Eugene, Oreg. 97405

[21] Appl. No.: 45,419

[22] Filed: May 4, 1987

[51] Int. Cl.[4] ..... A41D 1/06; A41D 27/20

[52] U.S. Cl. ..... 2/228; 2/238; 2/247; 2/250; 2/253

[58] Field of Search ..... 2/227, 228, 238, 231, 2/401, 406, 407, 408, 403, 247, 250, 253; 128/106–109, 132, 168, 159

[56] References Cited

U.S. PATENT DOCUMENTS

| | | | |
|---|---|---|---|
| 549,048 | 10/1895 | Basch | 2/227 |
| 585,210 | 6/1897 | Isaacs | 2/227 |
| 1,468,072 | 9/1923 | Ogle | 2/227 X |
| 1,711,611 | 5/1929 | Mock | 2/227 |
| 2,428,881 | 10/1947 | Kispert | 2/407 X |
| 3,310,053 | 3/1967 | Greenwood | 128/132 R |
| 3,909,847 | 10/1975 | Holt et al. | 2/401 X |
| 4,035,844 | 7/1977 | Atack et al. | 2/227 X |

*Primary Examiner*—H. Hampton Hunter

*Attorney, Agent, or Firm*—James D. Givnan, Jr.

[57] ABSTRACT

A pants garment having a pad retention member and liner sewn in place within the crotch and lower seat portion of the garment. Lines of stitching define rear and frontal pockets within which are retained resilient pads which cushion muscle and tissue of the anatomy subjacent the pelvis. Unstitched segments of the main member and liner provide openings for insertion and removal of the pads which may be of selected thicknesses to provide the desired amount of cushioning. Paired rear pads cushion the ischium of the pelvis while a forward pad cushions the pubic structure of the pelvis. Unfolding of the pads subsequent to pocket insertion contributes toward pad retention.

9 Claims, 1 Drawing Sheet

PADDED PANT CONSTRUCTION FOR ATHLETIC PURPOSES

BACKGROUND OF THE INVENTION

The present invention pertains generally to a garment with padding for protecting the lower torso when the wearer is seated.

In riding of bicycles, certain areas of the torso are subjected to severe impact loads. Efforts to cushion the torso include the usual provision of padded bicycle seat structures and resilient seat covers the most common being of sheepskin and fleece. The foregoing solutions are adequate to some extent particularly for those riding for short periods of time over smooth surfaces.

A problem exists in protecting that fleshy portion of the anatomy subjacent the pelvis especially for those engaged in riding over lengthy periods of time such as those cyclists engaging in competition of touring. Without adequate cushioning, bruising of tissue below the ischial tuberosities can occur was well as injury to muscles proximate the ischium and nerves proximate the pubic areas.

Known cushioning efforts do not lend themselves to convenient altering the amount of cushioning provided.

SUMMARY OF THE PRESENT INVENTION

The present invention is embodied within a pants garment having padding means within the crotch portion to protect load bearing tissue and nerves when the wearer is seated.

The garment may be embodied in a pair of shorts suited for wear by cyclists with padding confined in the crotch and seat areas of the shorts without hindering leg motion or causing bulkiness of the attire. The padding may be in the form of multiple pads located to provide the desired cushioning. Pad retention means confines the padding. Provision is made for pad removal and substitution to best suit present purposes and user's anatomy. The pad retention means, in place within the garment, insertably receives the pads and holds same in place at strategic points conducive to rider comfort.

Important objectives include the provision of a protective pants garment for wear by those participating in an activity wherein sudden and severe loads are imparted to the lower torso as for example bicycling; the provision of a pants garment having pad retention means which confines padding in a removable manner so as to cushion those parts of the lower torso otherwise subjected to injurious loading; the provision of a pants garment with pad retention means providing for confinement of cushioning pads in a removable manner to permit adapting the padding to suit individual preferences; the provision of a pants garment with pad retention means and padding shaped to snugly fit about the body to avoid adding bulkiness to the wearer's attire; the provision of pad retention means which may be of unitary construction for ease of pants installation.

DETAILED DESCRIPTION OF THE PREFERRED EMBODIMENTS

Figure 1:
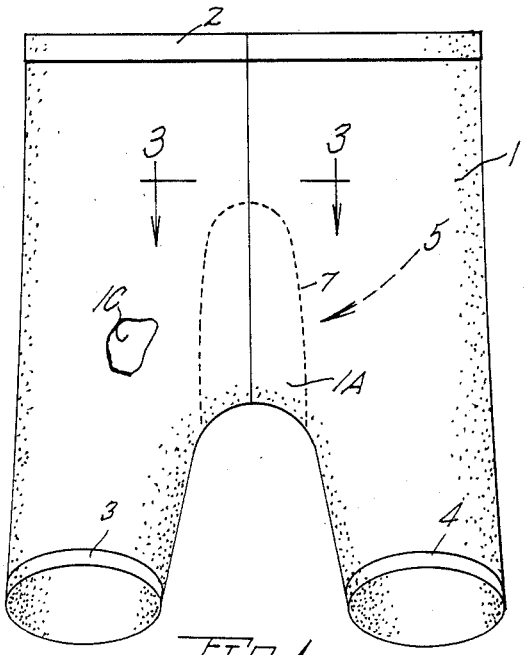
FIG. 1 is a front elevational view of a pair of bicycle shorts garment embodying the present invention.
Figure 2:
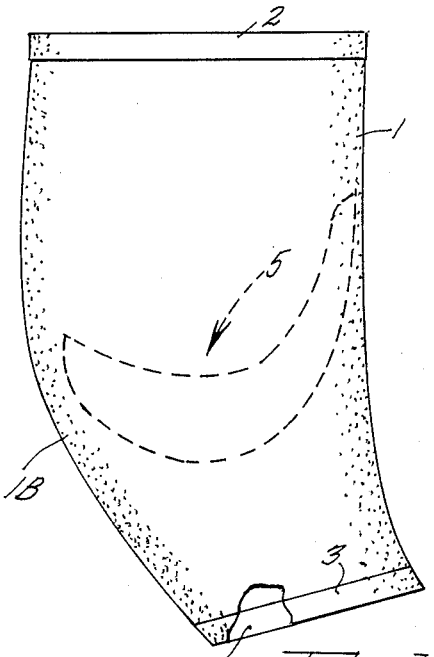
FIG. 2 is a side elevational view taken from the left-hand side of FIG. 1.

With continuing attention to the drawing wherein applied reference numerals indicate parts similarly hereinafter identified, the reference numeral 1 indicates a garment of the pants type for the lower human torso which garment may be in the form of bicycle shorts. A crotch portion is at 1A while a lower seat portion is at 1B.

Typically the bicycle shorts include an elasticized waist band 2 and elasticized bands at 3 and 4 which fit about the wearer's upper legs in a snug manner. The garment interior surface is at 1C.

While bicycle shorts are shown and described, it is understood that the present invention is usable with other types of pants garments worn by individuals engaging in athletics or other activities wherein the pelvic area of the torso is subjected to impact loads.

Indicated generally at 5 are pad confinement means in place internally within garment 1. Such confinement means are located interiorally within the lower seat portion and the crotch portion of the garment. In the following description, the terms inner, outer, anterior and posterior are relative the lower torso. An inner main fabric member 6 of the pad confinement means is stitched at 7 substantially about its perimeter to the perimeter of an outer liner L of corresponding shape. Stitching 7 also passes through the pant material. Main member 6 is located below the wearer's pelvis with points A and B indicating areas of maximum ischium exerted pressure while points C and D indicate points of maximum pressure exerted by the wearer's pubic bone structure. Accordingly, the present pad confinement means is disposed intermediate the lowermost extremities of the pelvis and a seat.

Main member 6 has inwardly recessed, edge free segments at 8 and 9 as well as at 10 and 11 which provide openings to permit passage of later described pad means. Forward and rearward portions at 6A–6B of main member 6 are associated with the anterior and posterior of the pelvis.

Main member 6 is preferably formed from two pieces of fabric wherein the forward portion 6A terminates rearwardly along a curved edge stitched at 12 to a correspondingly curved edge of the rearward portion of the main member. Such construction permits the pad confinement means to adapt to the curvature of the crotch portion of the pant to prevent imparting an undesired bulky appearance to the garment.

Figure 4:
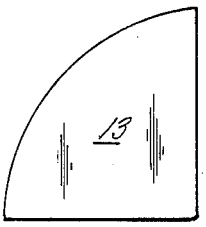
FIGS. 4 and 5 are plan views of rear pads shown removed from the pant structure.
Figure 5:
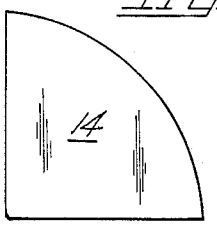
Figure 6:
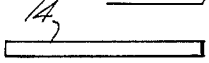
FIG. 6 is a bottom elevational view of the rear pad shown in FIG. 5.
Figure 3:
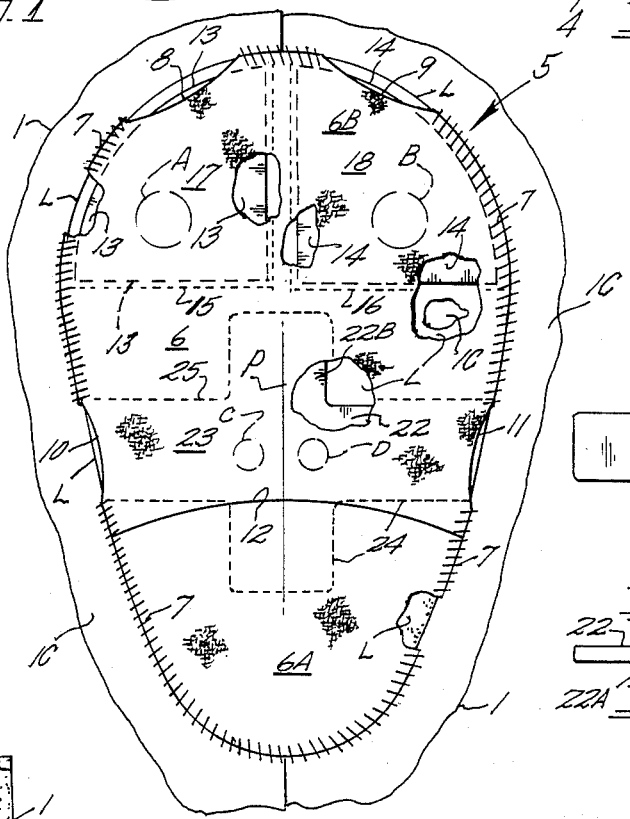
FIG. 3 is a horizontal sectional view taken along line 3—3 of FIG. 1 with the portion shown flattened into planar form.
Figure 7:
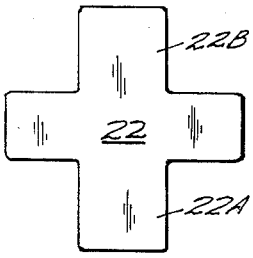
FIG. 7 is a plan view of a front pad shown removed from the pants garment.
Figure 8:
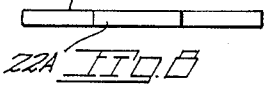
FIG. 8 is a bottom elevational view of the front pad shown in FIG. 7.
Figure 9:
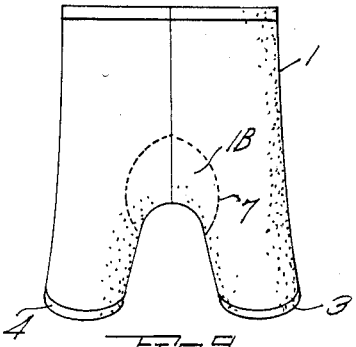
FIG. 9 is a rear view of FIG. 1 on a reduced scale.

Pad means includes rear pads at 13 and 14, as shown in FIGS. 4, 5 and 6, are confined in place within the confinement means 5 at positions to cushion the pelvis at the aforementioned points, A and B. For retention of the pads in place, main member 6 is stitched at 15–16 to liner L to form pad receiving rear pockets 17 and 18. More specifically, the stitching at 15–16 defines the interior limits of pockets 17–18 further defined by perimeter stitching 7 to receive pads 13 and 14. A frontal pad at 22, which may be of cruciform shape, is confined within a front pocket 23 defined by stitching 24 and 25 which, as was the case with the earlier defined stitched pockets, also passes through liner L. Accordingly, upon insertion of frontal pad 22, the wings 22A and 22B thereof will flex outwardly to occupy forwardly and rearwardly extending pocket extensions in communication with transversely extending pocket 23.

The pads are preferably formed from a synthetic, resilient foam material of cellular foam, such as neoprene foam or vinylnitril foam, in a range of thicknesses from ⅛ inch through ¼ of an inch or so with such permitting the user to select the most effective padding thickness. The main member is formed from a material having a napped or felt surface, one such suitable fabric being of polypropylene fiber. Such fabric tends to frictionally adhere to the pads to inhibit pad movement within their respective pockets. The openings 8–11 for pad passage are of lesser width than the associated pocket to assure pad confinement.

The liner has been found suitable when made of a tricot material. The use of a liner permits pad retention means to be constructed as a unit and incorporated into the interior of the pants by the overlock stitching at 7 about the perimeter of main member 6 and the liner except, of course, for free edge segments or openings 8, 9, 10 and 11 of the main member.

A front-to-rear vertical medial plane is at P intersects front pocket 23 while rear pockets 17 and 18 are laterally offset from same. Pad insertion and removal is accomplished with temporary folding of the pads for passage through the pocket associated opening.

While we have shown but one embodiment of the invention, it will be apparent to those skilled in the art that the invention may be embodied still otherwise without departing from the spirit and scope of the invention.

Having thus described the invention, what is desired to be secured in a Letters Patent is:

I claim:

1. A protective pants garment for athletic use, said garment comprising, pants structure for wear about the lower torso and having a crotch portion and a seat portion, pad means comprising multiple pads, and pad confinement means in place within the crotch portion and seat portion of said pants structure and defining pockets within which said pads are confined, said pad confinement means also defining openings for the insertion and removal of said pads into and out of said pockets, said pad confinement means defined openings are of a size to require folding of the pad associated therewith during pad insertion and removal, said pockets are each of a size to receive pads of different thicknesses.

2. The protective garment claimed in claim 1 wherein some of said pockets are laterally offset from a front-to-rear medial vertical plane of the garment.

3. The protective garment claimed in claim 1 wherein other of said pockets are intersected by said front-to-rear medial vertical plane of the garment.

4. In a pair of shorts for a bicyclist the improvement comprising, pad retention means fixed in place in the crotch and lower seat portions of said shorts and defining pockets each for the reception of a pad, said pad retention means including a main member and a liner superimposed on one another and stitching therethrough further defining said pockets, said pockets in front-to-rear relationship with one another and located both medially and laterally offset from a front-to-rear medial vertical plane of the shorts and below portions of the pelvis normally supported by a bicycle seat, said pad retention means defining pocket openings of lesser size than said pad whereby a pad in a pocket is confined within the pad retention means during wearing of the shorts.

5. Bicycle shorts comprising in combination, a pants garment having a crotch portion and a lower seat portion, multiple pads including paired rear pads in said lower seat portion of the garment, and pad retention means in place on said crotch portion and said lower seat portion of said garment and including a main member defining pockets and pocket openings for the reception of said pads.

6. The bicycle shorts claimed in claim 1 additionally including a liner interposed between said main member and said pants garment, said liner secured to said main member.

7. The bicycle shorts claimed in claim 1 wherein said pockets are also defined by stitching passing through said main member and said liner.

8. The bicycle shorts claimed in claim 1 additionally including a front pad in said crotch portion of the garment.

9. The bicycle shorts claimed in claim 1 wherein said main member is spaced from said garment so as to permit said pockets to receive pads of different thicknesses.

* * * * *